US010145283B2

(12) United States Patent
Geyer

(10) Patent No.: US 10,145,283 B2
(45) Date of Patent: Dec. 4, 2018

(54) DIESEL ENGINE SYSTEM AND METHOD AND APPARATUS FOR HANDLING DIESEL ENGINE EXHAUST

(75) Inventor: Stephen Geyer, State Line, PA (US)

(73) Assignee: Volvo Lastvagnar AB, Göteborg (SE)

( * ) Notice: Subject to any disclaimer, the term of this patent is extended or adjusted under 35 U.S.C. 154(b) by 945 days.

(21) Appl. No.: 13/201,113

(22) PCT Filed: Mar. 5, 2009

(86) PCT No.: PCT/US2009/036127

§ 371 (c)(1),
(2), (4) Date: Aug. 11, 2011

(87) PCT Pub. No.: WO2010/101570

PCT Pub. Date: Sep. 10, 2010

(65) Prior Publication Data

US 2011/0314794 A1 Dec. 29, 2011

(51) Int. Cl.
*F01N 3/00* (2006.01)
*F01N 3/20* (2006.01)
(Continued)

(52) U.S. Cl.
CPC ..... *F01N 3/2053* (2013.01); *F01N 3/0842* (2013.01); *F01N 13/009* (2014.06); *F01N 3/023* (2013.01); *F01N 3/2066* (2013.01)

(58) Field of Classification Search
CPC ..... F01N 3/2053; F01N 3/031; F01N 3/023; F01N 3/009
(Continued)

(56) References Cited

U.S. PATENT DOCUMENTS 3,788,284 A * 1/1974 Gardner ..... 123/676
5,331,809 A * 7/1994 Takeshima et al. ..... 60/288
(Continued)

FOREIGN PATENT DOCUMENTS

DE 10200501547910200 A1 10/2006
EP 0957254 A2 11/1999
(Continued)

OTHER PUBLICATIONS

Cummins Inc., Cummins 2008 ON-Highway Engines to be Clean Idle Certified, Sep. 23, 2007, http://cumminsengines.com/cummins-2008-onhighway-engines-to-be-clean.*
(Continued)

*Primary Examiner* — Audrey K Bradley
*Assistant Examiner* — Anthony Ayala Delgado
(74) *Attorney, Agent, or Firm* — WRB-IP LLP

(57) ABSTRACT

A diesel engine system includes a diesel engine, a NOx control device downstream of the engine, an exhaust line between the engine and the NOx control device, a bypass line connected to the exhaust line at a first end upstream of the NOx control device, and a bypass valve connecting the exhaust line and the bypass line, the bypass valve permitting flow through the exhaust line to the NOx control device when in an open position and preventing flow through the exhaust line to the NOx control device and permitting flow through the exhaust line to the bypass line when in a closed position. A controller can arranged to control opening and dosing of the bypass valve, such as when an operating condition of the engine reaches a predetermined operating condition.

20 Claims, 1 Drawing Sheet

(51) Int. Cl.
*F01N 3/08* (2006.01)
*F01N 13/00* (2010.01)
*F01N 3/023* (2006.01)

(58) Field of Classification Search
USPC ..... 60/274, 288, 292, 295, 297, 300, 287, 60/303, 324
See application file for complete search history.

(56) References Cited

U.S. PATENT DOCUMENTS

| | | | | |
|---|---|---|---|---|
| 6,192,675 | B1 | 2/2001 | Hirota et al. | |
| 6,233,927 | B1 * | 5/2001 | Hirota et al. | 60/297 |
| 6,810,657 | B1 | 11/2004 | Benninger et al. | |
| 6,837,043 | B2 | 1/2005 | Nakatani et al. | |
| 6,871,490 | B2 * | 3/2005 | Liang et al. | 60/286 |
| 2004/0112046 | A1 | 6/2004 | Tumati et al. | |
| 2006/0283178 | A1 * | 12/2006 | Akagawa | 60/286 |
| 2007/0157608 | A1 * | 7/2007 | Gandhi et al. | 60/286 |
| 2008/0028744 | A1 | 2/2008 | Kass et al. | |
| 2008/0163609 | A1 * | 7/2008 | Satou et al. | 60/287 |
| 2009/0114196 | A1 * | 5/2009 | Haugen | 123/575 |
| 2009/0199537 | A1 * | 8/2009 | Sisken et al. | 60/273 |
| 2010/0071353 | A1 * | 3/2010 | Bourdon et al. | 60/287 |

FOREIGN PATENT DOCUMENTS

| | | | |
|---|---|---|---|
| EP | 1431533 | A2 | 6/2004 |
| JP | 200045755 | A | 2/2000 |
| JP | 2000-297631 | A | 10/2000 |
| JP | 2003286835 | A | 10/2003 |
| JP | 2008248878 | A | 10/2008 |
| WO | 2008027122 | A1 | 3/2008 |
| WO | WO 2008113471 | A1 * | 9/2008 |

OTHER PUBLICATIONS

International Search Report for corresponding International Application PCT/US2009/036127.
International Preliminary Report on Patentaibilty for corresponding International Application PCT/US2009/036127.
Japanese Official Action (dated Apr. 17, 2013) (translation) from corresponding Japanese Application No. 2011-552919.
Supplementary European Search Report (dated Jul. 22, 2013) for corresponding European App. EP 09 84 1247.
Office Action of corresponding Japan application No. 2011-552919 dated Dec. 24, 2013.
EPO Art.94(3) communication dated Jul. 13, 2016 for corresponding European application No. 09841247.1.

* cited by examiner

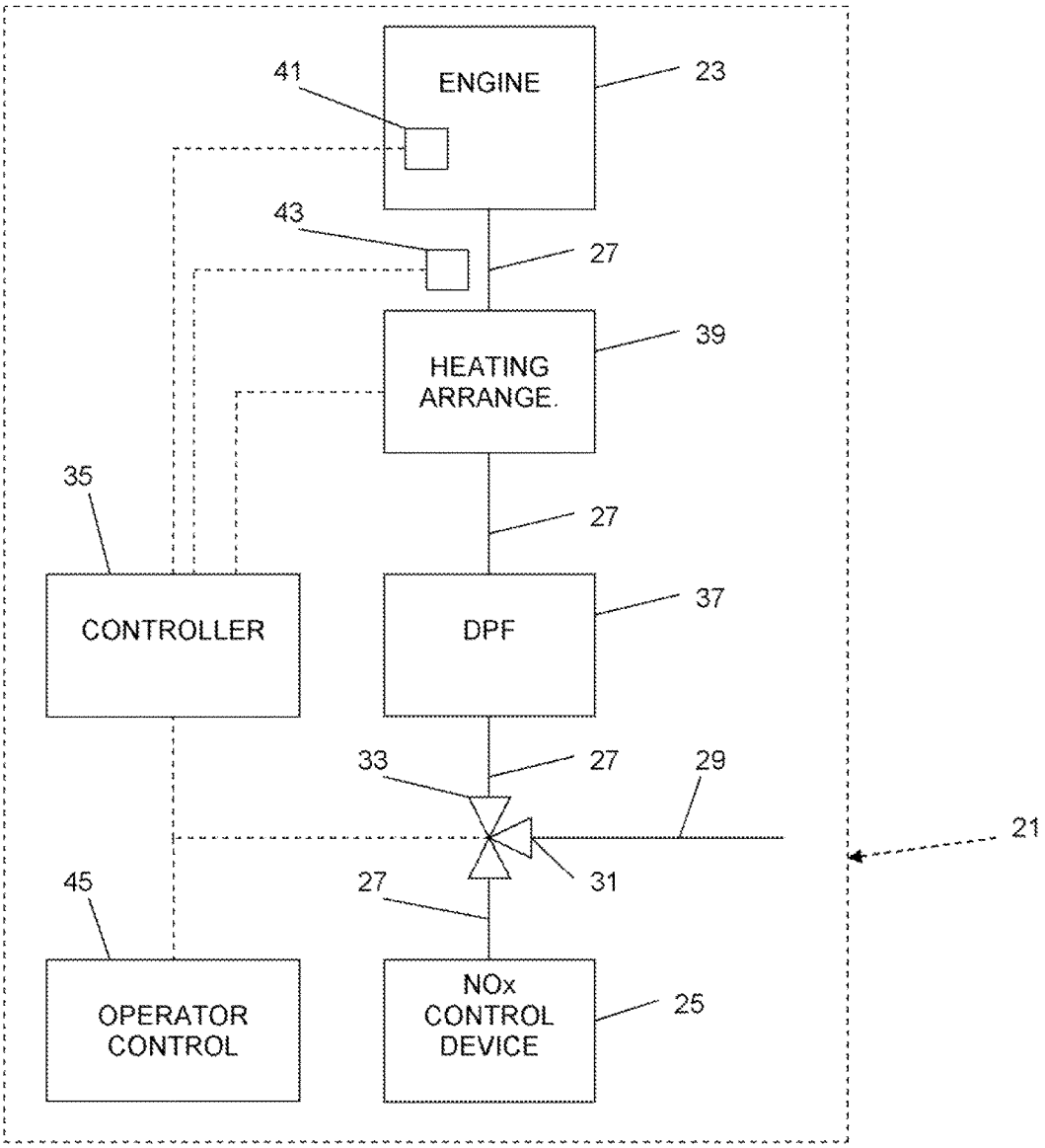
ENGINE
23
41
43
27
HEATING ARRANGE.
39
35
27
CONTROLLER
DPF
37
33
27
29
21
31
45
27
OPERATOR CONTROL
NOx CONTROL DEVICE
25

DIESEL ENGINE SYSTEM AND METHOD AND APPARATUS FOR HANDLING DIESEL ENGINE EXHAUST

BACKGROUND AND SUMMARY

The present invention relates generally to diesel engine systems and methods for handling diesel engine exhaust and, more particularly, to such systems and methods wherein NOx control devices can be bypassed.

Strict diesel engine emissions regulations have been proposed in the U.S. California, for example, has proposed regulations that require trucks to stop idling after no more than five minutes unless NOx emissions from the idling vehicles are limited to 30 grams/hr or less.

In response to such requirements, certain vehicles have been equipped with a "low NOx idle" feature which prevents NOx emissions over 30 grams/hr. While the particular engine operating conditions involved in a low NOx idle may vary from vehicle to vehicle, low NOx idle operating conditions typically involve operation at low load and low engine speed, such as at around 700 rpm. In addition, a low level of exhaust gas recirculation (EGR) may be employed. Other operating conditions may include that the engine be warmed up, parked, and below a particular elevation, such as 6000 feet.

During low NOx idle, exhaust temperatures are typically too low for a NOx control device such as a selective reduction catalyst (SCR) or a lean NOx trap (LNT) to operate effectively. The inventor has recognized that low NOx idle operation tends to produce low amounts of hydrocarbons which, over long term idling, can collect in the NOx control device and deactivate it and, according to an aspect of the present invention, proposes bypassing the NOx control device during low NOx idle engine operating conditions. The inventor has further recognized that the bypass system permits protection of the NOx control device when, for example, a diesel particulate filter (DPF) has an exotherm regeneration (such as may occur when exhaust gas is heated by a heater upstream of the DPF) and temperature of the exhaust gas may be too high for the NOx control device. Further, the inventor has recognized that the bypass system permits protection of the NOx control device when, due to any one or more of a variety of engine operating conditions or exhaust characteristics, it may be desirable to avoid sending the exhaust gas through the NOx control device.

In accordance with an aspect of the present invention, a diesel engine system comprises a diesel engine operable under a plurality of operating conditions, a NOx control device downstream of the engine, an exhaust line between the engine and the NOx control device, a bypass line connected to the exhaust line at a first end upstream of the NOx control device, and a bypass valve connecting the exhaust line and the bypass line, the bypass valve permitting flow through the exhaust line to the NOx control device when in an open position and preventing flow through the exhaust line to the NOx control device and permitting flow through the exhaust line to the bypass line when in a closed position. A controller is arranged to control opening and closing of the bypass valve when at least one operating condition of the plurality of operating conditions reaches a predetermined operating condition.

In accordance with another aspect of the present invention, a diesel engine system comprises a diesel engine, a NOx control device downstream of the engine, an exhaust line between the engine and the NOx control device, a bypass line connected to the exhaust line at a first end downstream of the engine and upstream of the NOx control device, and a bypass valve connecting the exhaust line and the bypass line, the bypass valve permitting flow through the exhaust line to the NOx control device when in an open position and preventing flow through the exhaust line to the NOx control device and permitting flow through the exhaust line to the bypass line when in a closed position. A controller is arranged to control opening and closing of the bypass valve when a temperature of gas in the exhaust line upstream of the NOx control device exceeds a predetermined value.

In accordance with another aspect of the present invention, a method for handling diesel engine exhaust comprises operating a diesel engine under a plurality of operating conditions, exhausting gas from the engine to an exhaust line downstream of the engine, a NOx control device being disposed in the exhaust line downstream of the engine and a bypass line being connected to the exhaust line at a first end upstream of the NOx control device, moving a bypass valve connecting the exhaust line and the bypass line between an open and a closed position, the bypass valve permitting flow through the exhaust line to the NOx control device when in the open position and preventing flow through the exhaust line to the NOx control device and permitting flow through the exhaust line to the bypass line when in the closed position, and closing the bypass valve when at least one operating condition of the plurality of operating conditions reaches a predetermined operating condition.

In accordance with yet another aspect of the present invention, a method for handling diesel engine exhaust comprises operating a diesel engine under a plurality of operating conditions, exhausting gas from the engine to an exhaust line downstream of the engine, a NOx control device being disposed in the exhaust line downstream of the engine, a bypass line being connected to the exhaust line at a first end upstream of the NOx control device, moving a bypass valve connecting the exhaust line and the bypass line between an open and a closed position, the bypass valve permitting flow through the exhaust line to the NOx control device when in the open position and preventing flow through the exhaust line to the NOx control device and permitting flow through the exhaust line to the bypass line when in the closed position, and closing the bypass valve when a temperature of gas in the exhaust line upstream of the NOx control device exceeds a predetermined value.

BRIEF DESCRIPTION OF THE DRAWINGS

The features and advantages of the present invention are well understood by reading the following detailed description in conjunction with the drawings in which like numerals indicate similar elements and in which:

FIG. 1 is a schematic view of a diesel engine system according to an aspect of the present invention.

DETAILED DESCRIPTION

A diesel engine system 21 according to an aspect of the present invention is shown in FIG. 1. The system 21 comprises a diesel engine 23 operable under a plurality of operating conditions. The system also comprises a NOx control device 25 such as a selective reduction catalyst (SCR) or a lean NOx trap (LNT) downstream of the engine 23 and an exhaust line 27 between the engine and the NOx control device.

A bypass line 29 is connected to the exhaust line 27 at a first end 31 of the bypass line upstream of the NOx control device 25. A bypass valve 33 connects the exhaust line 27 and the bypass line 29. The bypass valve 33 permits flow through the exhaust line 27 to the NOx control device 25 when the bypass valve is in an open position and prevents flow through the exhaust line to the NOx control device and permits flow through the exhaust line to the bypass line 29 when in a closed position. Ordinarily, the bypass valve 33 prevents flow through the exhaust line to the bypass line 29 when the bypass valve is in the open position. Ordinarily, it will only be desirable to have the bypass valve 33 be movable to a fully open or a fully closed position and in which all flow entering the bypass valve is either to the NOx control device 25 or to the bypass line 29. However, in the event that it is desirable to have some amount less than 100% of the exhaust gas entering the bypass valve 33 flow from the exhaust line 29 to the NOx control device 25 and/or have some amount less than 100% of the exhaust gas flows from the exhaust line to the bypass line, a bypass valve can be provided that is movable to a position between fully open and fully closed.

A controller 35 can be arranged to control opening and closing of the bypass valve 33 when at least one operating condition of the plurality of operating conditions reaches a predetermined operating condition. According to one aspect of the present invention, the at least one operating condition can comprise operation of the engine 23 under low NOx idle operating conditions, defined for purposes of the present application as conditions wherein the engine is operated at sufficiently low loads and engine speed such that NOx emissions are less than 30 g/hr after idling for 3 minutes. The controller 35 can be arranged to close the bypass valve 33 when the engine 23 is operated under such low NOx idle operating conditions.

The controller 35 can also, or alternatively, be arranged to control opening and closing of the bypass valve 33 when a temperature of gas in the exhaust line 27 upstream of the NOx control device 25 exceeds a predetermined value. For example, the system 21 can comprise a diesel particulate filter (DPF) 37 downstream of the engine 23 and upstream of the NOx control device 25, the bypass line 29 can be connected to the exhaust line 27 via the bypass valve 33 downstream of the DPF, and a heating arrangement 39 can be provided upstream of the DPF and operable to heat exhaust gas in the exhaust line for active regeneration of the DPF. The controller 35 can be arranged to close the bypass valve 33 when the heating arrangement 39 operates. The controller 35 can control the bypass valve 33 to open and close irrespective of any engine operating conditions.

The controller 35 can also, or alternatively, be arranged to control opening and closing of the bypass valve 33 when the at least one operating condition comprises operation with fuel having at least one characteristic outside of a range of characteristics. For example, the engine 23 may be operable with either low sulfur fuel or high sulfur fuel, however, operation with high sulfur fuel may cause damage to a NOx control device 25.

A sensor 41 for sensing the at least one operating condition, e.g., operation with high sulfur fuel, can be provided. The sensor 41 can be arranged to send a signal to the controller 35 indicating that the at least one operating condition has reached the predetermined operating condition, e.g., operation with high sulfur fuel has begun. In response, the controller 35 can control the bypass valve 33 to close so that the NOx control device 25 is bypassed. Sensors can be provided to detect other operating conditions as well, such as the conditions under which low NOx idle is performed.

A sensor 43 can also be provided downstream of the engine 23 for sensing information other than engine operating conditions, such as exhaust characteristics such as exhaust temperature, and send a signal to the controller 35 to control the bypass valve 33 to close so that the NOx control device 25 is bypassed. For example, during active, O2-based regeneration of the DPF 37, the heating arrangement 39 can heat the exhaust gas to a temperature above a safe operating temperature for the NOx control device 25. The sensor 43 can sense that temperature has risen to some predetermined temperature below the temperature at which damage would be expected to occur to the NOx control device 25 and send a signal to the controller 35 so that the bypass valve 33 will close and damage to the NOx control device will be avoided.

An operator control 45 such as a switch or a keypad can be provided for sending a signal to the controller 35 indicating that the at least one operating condition has reached the predetermined operating condition so that the bypass valve 33 will close and the NOx control device 35 will be bypassed via the bypass line 29. The operator control 45 can be operated manually by an operator when, for example, it is known that operation under low NOx idle conditions will be begun, when active O2-based regeneration of the DPF 37 is to be initiated, or operation with high sulfur fuel will be begun. The illustrative operating conditions and exhaust characteristics under which it will ordinarily be desirable to bypass the NOx control device 25 is not, of course, necessarily limited to these conditions and characteristics.

In a method for handling diesel engine 23 exhaust according to an aspect of the present invention, the diesel engine can be operated under a plurality of operating conditions, gas is exhausted from the engine to the exhaust line 27 downstream of the engine, the NOx control device 25 being disposed in the exhaust line downstream of the engine and the bypass line 29 being connected to the exhaust line at a first end 31 upstream of the NOx control device. The bypass valve 33 connecting the exhaust line 27 and the bypass line 29 is moved between the open and the closed position, where the bypass valve permits flow through the exhaust line to the NOx control device 25 when in the open position and prevents flow through the exhaust line to the NOx control device and permits flow through the exhaust line to the bypass line when in the closed position.

The bypass valve 33 can be closed, such as by the controller 35 or manually via the operator control 45, when at least one operating condition of the plurality of operating conditions reaches a predetermined operating condition, for example, a predetermined operating condition comprising operation of the engine under low NOx idle operating conditions, or operation with high sulfur fuel. Alternatively, or in addition, the bypass valve 33 can be closed, such as by the controller 35 or manually via the operator control 45, when a temperature of gas in the exhaust line upstream of the NOx control device exceeds a predetermined value, or when the heating arrangement 39 for performing an active O2-based regeneration of the DPF 37 operates.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. A diesel engine system, comprising:

a diesel engine operable under a plurality of operating conditions;

a NOx control device downstream of the engine;

an exhaust line between the engine and the NOx control device;

a bypass line connected to the exhaust line at a first end upstream of the NOx control device, wherein no NOx control device is provided in the bypass line;

a bypass valve connecting the exhaust line and the bypass line, the bypass valve permitting flow through the exhaust line to the NOx control device when in an open position and preventing flew through the exhaust line to the NOx control device and permitting flow through the exhaust line to the bypass line when in a closed position; and a controller configured to close the bypass valve when at least tone operating condition of the plurality of operating conditions reaches a predetermined operating condition, wherein the at least one operating condition comprises operation of the engine under low NOx idle operating conditions.

2. The diesel engine system as set forth in claim 1, wherein the controller is configured to control opening and dosing of the bypass valve when a temperature of gas in the exhaust line upstream of the NOx control device exceeds a predetermined value.

3. The diesel engine system as set forth in claim 2, comprising a diesel particulate filter (DPF) downstream of the engine and upstream of the NOx control device, the bypass line being connected to the exhaust line downstream of the DPF, and a heating arrangement upstream of the DPF operable to heat exhaust gas in the exhaust line for active regeneration of the DPF, the controller dosing the bypass valve when the heating arrangement operates.

4. The diesel engine system as set forth in claim 1, wherein the at least one operating condition comprises operation with libel having at least one characteristic outside of a range of characteristics.

5. The diesel engine system as set forth in claim 1, comprising a sensor for sensing the at least one operating condition, the sensor being configured to send a signal to the controller indicating that the at least one operating condition has reached the predetermined operating condition.

6. The diesel engine system as set forth in claim 1, comprising an operator control for sending a signal to the controller indicating that the at least one operating condition has reached the predetermined operating condition.

7. The diesel engine system as set forth in claim 1, wherein the bypass valve is movable to only a fully open and a fully closed state.

8. The diesel engine system as set forth in claim 1, wherein the NOx control device comprises a selective reduction catalyst (SCR).

9. The diesel engine system as set forth in claim 1, wherein the NOx control device comprises a lean NOx trap (LNT).

10. The diesel engine system as set forth in claim 1, wherein the controller is configured to maintain the bypass valve closed when the engine is operated under low NOx idle operating conditions.

11. A diesel engine system, comprising:

a diesel engine;

a NOx control device downstream of the engine;

an exhaust line between the engine and the NOx control device;

a bypass line connected to the exhaust line at a first end downstream of the engine and upstream of the NOx control device, wherein no NOx control device is provided in the bypass line;

a bypass valve connecting the exhaust line and the bypass line, the bypass valve permitting flow through the exhaust line to the NOx control device when in an open position and preventing flow through the exhaust line to the NOx control device and permitting flow through the exhaust line to the bypass line when in a closed position; and a controller configured to close the bypass valve when the engine is operated under low NOx idle operating conditions.

12. The diesel engine system asset forth in claim 11, comprising a diesel particulate filter (DPF) downstream of the engine and upstream of the NOx control device, the bypass line being connected to the exhaust line downstream of the DPF, and a heating arrangement upstream of the DPF operable to heat exhaust gas in the exhaust line for active regeneration of the DPF, the controller closing the bypass valve when the heating arrangement operates.

13. A method for handling diesel engine exhaust, comprising:

operating a diesel engine under a plurality of operating conditions;

exhausting gas from the engine to an exhaust line downstream of the engine, a NOx control device being disposed in the exhaust line downstream of the engine and a bypass line being connected to the exhaust line at a first end upstream of the NOx control device, no NOx control device being provided in the bypass line;

moving a bypass valve connecting the exhaust line and the bypass line between an open and a closed position, the bypass valve permitting flow through the exhaust line to the NOx control device when in the open position and preventing flow through the exhaust line to the NOx control device and permitting flow through the exhaust line to the bypass line when in the closed position; and closing the bypass valve when at least one operating condition of the plurality of operating conditions reaches a predetermined operating condition, wherein the at least one operating condition comprises operation of the engine under low NOx idle operating conditions and the controller is configured to close the bypass valve when the engine is operated under low NOx idle operating conditions.

14. The method for handling diesel engine exhaust as set forth in claim 13, comprising dosing the bypass valve when a temperature of vas in the exhaust line upstream of the NOx control device exceeds a predetermined value.

15. The method for handling diesel engine exhaust as set forth in claim 14, wherein a diesel particulate filter (DPF) is disposed in the exhaust line downstream of the engine and upstream of the NOx control device, the bypass line being connected to the exhaust line downstream of the DPF, and a heating arrangement is disposed upstream of the DPF, the heating arrangement being operable to heat exhaust gas in the exhaust line for active regeneration of the DPF, the method comprising closing the bypass valve when the heating arrangement operates.

16. The method for handling diesel engine exhaust as set forth in claim 13, wherein the at least one operating condition comprises operation with fuel having at least one characteristic outside of a range of characteristics, the method comprising closing the bypass valve when the engine is operated with fuel having the at least characteristic outside of the range of characteristics.

17. The method for handling, diesel engine exhaust as set forth in claim 13, comprising moving the bypass valve only to fully open or fully closed positions.

18. The method for handling diesel engine exhaust as set forth in claim 13, comprising maintaining the bypass valve closed when the engine is operated under low NOx idle operating conditions.

19. A method for handling diesel engine exhaust, comprising:

operating a diesel engine under a plurality of operating conditions;

exhausting gas from the engine to an exhaust line downstream of the engine, a NOx control device being disposed in the exhaust line downstream of the engine, a bypass line being connected to the exhaust line at a first end upstream of the NOx control device, no NOx control device being provided in the bypass line;

moving a bypass valve connecting the exhaust line and the bypass line between an open and a closed position, the bypass valve permitting flow through the exhaust line to the NOx control device when in the open position and preventing flow through the exhaust line to the NOx control device and permitting flow through the exhaust line to the bypass line when in the closed position; and closing the bypass valve when the engine is operated under low NOx idle operating conditions.

20. The method for handling diesel engine exhaust as set forth in claim 19, wherein a diesel particulate filter (DPF) is disposed downstream of the engine and upstream of the NOx control device, the bypass line being connected to the exhaust line downstream of the DPF, and a heating arrangers is disposed upstream of the DPF, the heating arrangement being operable to heat exhaust gas in the exhaust line for active regeneration of the DPF, the method comprising closing the bypass valve when the heating arrangement operates.

* * * * *